US007267524B2

(12) United States Patent
Yu

(10) Patent No.: US 7,267,524 B2
(45) Date of Patent: Sep. 11, 2007

(54) FUEL PUMP HAVING SINGLE SIDED IMPELLER

(75) Inventor: DeQuan Yu, Ann Arbor, MI (US)

(73) Assignee: Ford Motor Company, Dearborn, MI (US)

( * ) Notice: Subject to any disclaimer, the term of this patent is extended or adjusted under 35 U.S.C. 154(b) by 722 days.

(21) Appl. No.: 10/842,676

(22) Filed: May 10, 2004

(65) Prior Publication Data

US 2005/0249617 A1 Nov. 10, 2005

(51) Int. Cl.
*F04D 5/00* (2006.01)

(52) U.S. Cl. ..... 415/55.1; 415/55.2; 417/369

(58) Field of Classification Search ..... 415/55.1, 415/55.2, 55.3, 55.4, 55.5, 55.6, 55.7, 232; 417/369, 423.1

See application file for complete search history.

(56) References Cited

U.S. PATENT DOCUMENTS

| | | | |
|---|---|---|---|
| 1,619,286 | A | 3/1927 | Burks |
| 1,861,837 | A | 6/1932 | Burks |
| 1,861,838 | A | 6/1932 | Burks |
| 2,396,319 | A | 3/1946 | Edwards et al. |
| 3,360,193 | A | 12/1967 | Harris et al. |
| 3,392,675 | A | 7/1968 | Taylor |
| 3,395,853 | A | 8/1968 | Zoehfeld |
| 3,506,373 | A | 4/1970 | Danker et al. |
| 3,836,291 | A | 9/1974 | Bottcher et al. |
| 3,871,797 | A | 3/1975 | Igarashi et al. |
| 3,873,243 | A | 3/1975 | Nusser et al. |
| 4,295,797 | A | 10/1981 | Ruhl et al. |
| 4,336,002 | A | 6/1982 | Rose et al. |
| 4,462,761 | A | 7/1984 | Ringwald |
| 5,364,228 | A | 11/1994 | Henning et al. |
| 5,487,650 | A | 1/1996 | Gaston et al. |
| 5,513,950 | A | 5/1996 | Yu |
| 5,569,023 | A | 10/1996 | Ishida et al. |
| 5,762,469 | A | 6/1998 | Yu |
| 6,068,454 | A | 5/2000 | Gaston et al. |
| 6,116,850 | A | 9/2000 | Yu |
| 6,162,012 | A | 12/2000 | Tuckey et al. |
| 6,174,128 | B1 | 1/2001 | Yu |
| 6,210,102 | B1 | 4/2001 | Yu et al. |
| 6,270,310 | B1 | 8/2001 | Gaston et al. |
| 6,296,439 | B1 | 10/2001 | Yu et al. |
| 6,299,406 | B1 | 10/2001 | Yu et al. |
| 6,527,505 | B2 | 3/2003 | Yu et al. |
| 6,641,361 | B2 | 11/2003 | Yu |
| 6,669,437 | B2 | 12/2003 | Yu et al. |
| 6,688,844 | B2 | 2/2004 | Yu |
| 7,008,174 | B2 * | 3/2006 | Yu et al. ..... 415/55.1 |

FOREIGN PATENT DOCUMENTS

| | | | |
|---|---|---|---|
| JP | 61175297 A | * | 8/1986 |

* cited by examiner

*Primary Examiner*—Igor Kershteyn
(74) *Attorney, Agent, or Firm*—Greg Brown; MacMillan, Sobanski o Todd LLC

(57) ABSTRACT

A fuel pump is provided having improved efficiency by lowering the wet circle index of the pump while maintaining robust axial clearances to meet the demands of an automotive application. One embodiment includes a fuel pump for pressurizing fuel for delivery to an engine of a motor vehicle. The fuel pump generally comprises a housing, a motor, a single sided impeller, a cover and a body. The provision of a single sided impeller greatly reduces the wet circle index and improves the pump efficiency. The cover, impeller, and body are structured to axially balance the impeller which is free floating on the shaft of the motor.

22 Claims, 6 Drawing Sheets

FUEL PUMP HAVING SINGLE SIDED IMPELLER

FIELD OF THE INVENTION

The present invention relates generally to automotive fuel pumps, and more particularly relates to a regenerative fuel pump having a rotary impeller.

BACKGROUND OF THE INVENTION

Regenerative fuel pumps have been widely used in automotive applications because of the low specific speed number (ratio of diameter and flow rate versus pressure), quiet operation, good handling of hot fuel, and durability. These regenerative fuel pumps generally include an impeller rotating on a shaft and positioned within an impeller chamber in the pump. The clearance between the opposing axial sides of the impeller and the corresponding walls of the impeller chamber must be closely regulated to permit the pump to handle fuel at relatively high pressures (i.e. greater than about 2 bar). The impellers are typically double sided impellers, meaning the impellers include vanes on each opposing side which have vanes positioned therein for pressurizing fuel on both sides of the impeller. In this manner, the impellers are relatively well balanced axially to maintain the necessary clearance for pumping high pressure fuel.

One drawback of these fuel pumps is that their wet circle index is relatively high, typically 1.7 or greater. The wet circle index is an index for the pump boundary layer and friction losses. The wet circle index can be defined as the wet circle length versus the flow channel cross-sectional area. That is, the wet circle length is the distance along the perimeter of the flow channel (i.e. circumference of a round flow channel), the follow channel being formed by both the impeller and the structures (e.g. body and cover structures) on opposing sides of the impeller.

Accordingly, there exist a need for a fuel pump with robust axial clearance requirements to permit pumping of high pressure fluid in an automotive environment, while at the same time having a lower wet circle index to reduce friction losses and improve the efficiency of the pump.

BRIEF SUMMARY OF THE INVENTION

The present invention provides a fuel pump that improves the pump efficiency by lowering the wet circle index of the pump while maintaining robust axial clearances to meet the demands of an automotive application. One embodiment of the invention includes a fuel pump for pressurizing fuel for delivery to an engine of a motor vehicle. The fuel pump generally comprises a housing, a motor, a single sided impeller, a cover and a body. The provision of a single sided impeller greatly reduces the wet circle index and improves the pump efficiency.

According to more detailed aspects, the motor is situated in the housing and drives a shaft. The impeller is connected to the shaft for rotation as well as for axial translation relative to the shaft. That is, the impeller is free floating on the shaft. The cover includes a flow channel which is aligned with a flow channel formed in the impeller, rotation of the impeller and its vanes pressurizing the lower pressure fuel provided at an inlet end of the cover flow channel, which is forced to an outlet end of the cover flow channel. The body defines an outlet passageway positioned radially outwardly from the impeller chamber to fluidically connect to the outlet end of the cover flow channel, thereby receiving higher pressure fuel for delivery to the engine.

The impeller is free floating on the shaft and is subjected to a cover-side force from fuel in the cover flow channel and the impeller flow channel, as well as a body-side force from fuel in the outlet passageway. The outlet passageway is at least partially exposed to the body side of the impeller, and the exposed area is sized to provide a body side axial force approximately equal to the cover-side axial force. In this way, the impeller is balanced on the shaft to provide robust axial clearances for pumping higher pressure fuel.

According to still further details, the exposed area on the body-side of the impeller is less than the area of the cover-side of the impeller exposed to the cover flow channel, as the pressure on the body-side is generally greater than the average pressure on the cover-side of the impeller. Additionally, one or both of the body and the cover may define pressure balance channels in fluidic communication with either high or low pressure fuel, which can be adjusted to provide a balanced impeller. The pressure balance channels may take many forms and may be positioned at various radial and circumferential positions.

In this way, the fuel pump of the present invention allows the impeller to maintain an axial clearance between the cover and the impeller that is less than or equal to 50 micron by sizing the area of the cover-side surface of the impeller that is exposed to fluid in relation to the area of the body-side surface of the impeller that is exposed to fuel. Likewise, the impeller maintains an axial clearance between the cover that is sufficient to pressurize fuel to at least 2 bar. Notably, the fuel pump does not require a bearing or other structural component to maintain the necessary clearance between the cover and the impeller.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
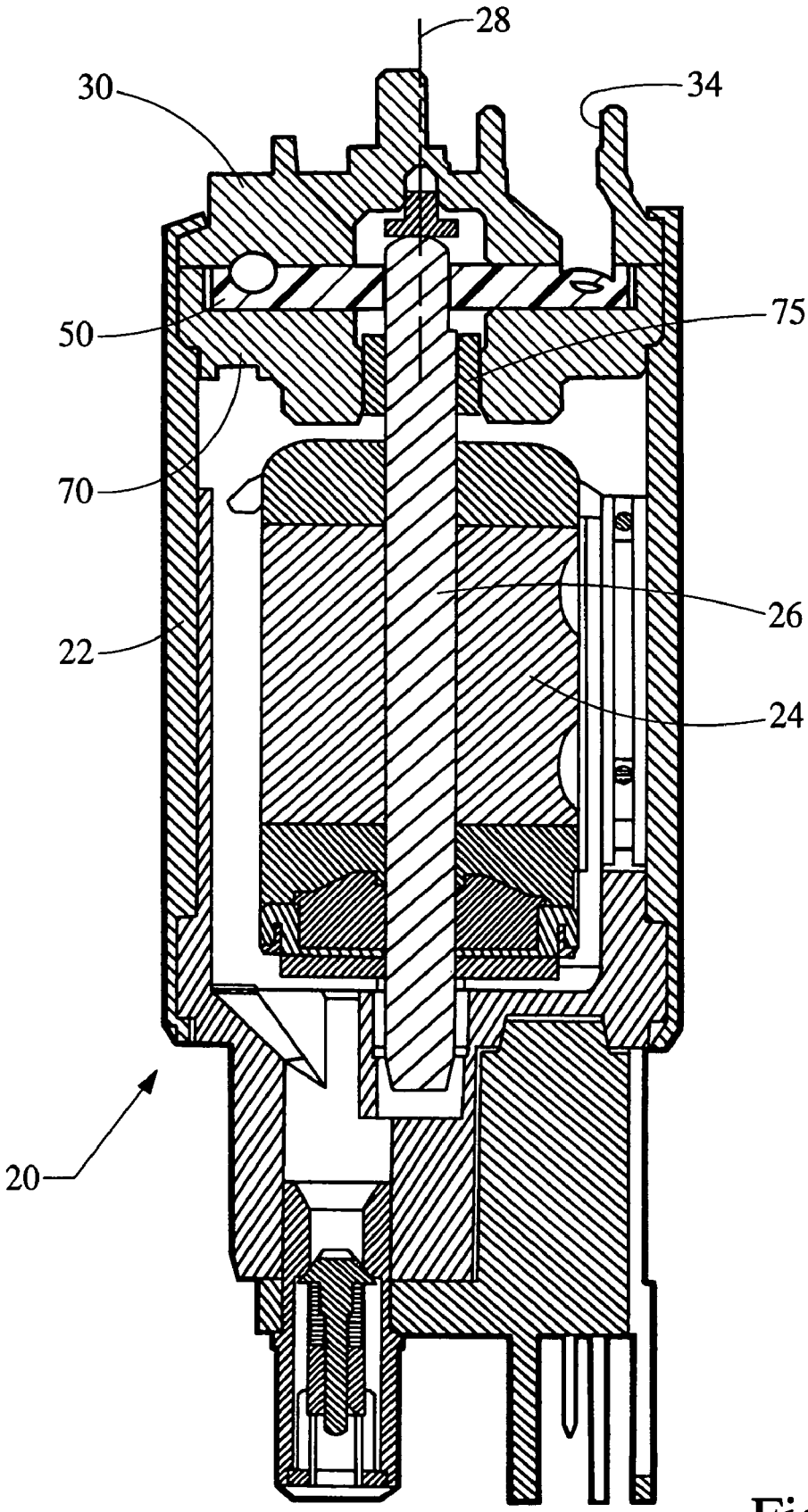
FIG. 1 is a cross-sectional view of a fuel pump constructed in accordance with the teachings of the present invention.

Turning now to the figures, FIG. 1 depicts a cross-sectional view of a fuel pump 20 constructed in accordance with the teachings of the present invention. Notably, the fuel pump 20 includes a single sided impeller 50 which greatly reduces the wet circle index from about 1.8 to about 1.1, thereby reducing friction losses and increasing the hydraulic efficiency of the pump 20 typically about 20%-35%. Furthermore, the single sided impeller 50 is free floating while maintaining an axial clearance that is sufficient to handle fuels at higher pressure, typically about 2 bar or greater.

As shown in FIG. 1, the pump 20 generally includes a housing 22 which encloses a motor 24 therein. The motor 24 is operatively connected to a shaft 26 which defines a central axis 28 of the pump 20. A cover 30 closes off the open end of the housing 22, and includes an inlet 34 for receiving lower pressure fuel. A body 70 is positioned inside the housing 22 and inside the cover 30. The impeller 50 is fitted between the cover 30 and body 70. The impeller 50 is fitted on the shaft 26 for rotation, as well as axial translation relative to the shaft. That is, the impeller 50 is free floating on the shaft 26 as previously mentioned.

Figure 2:
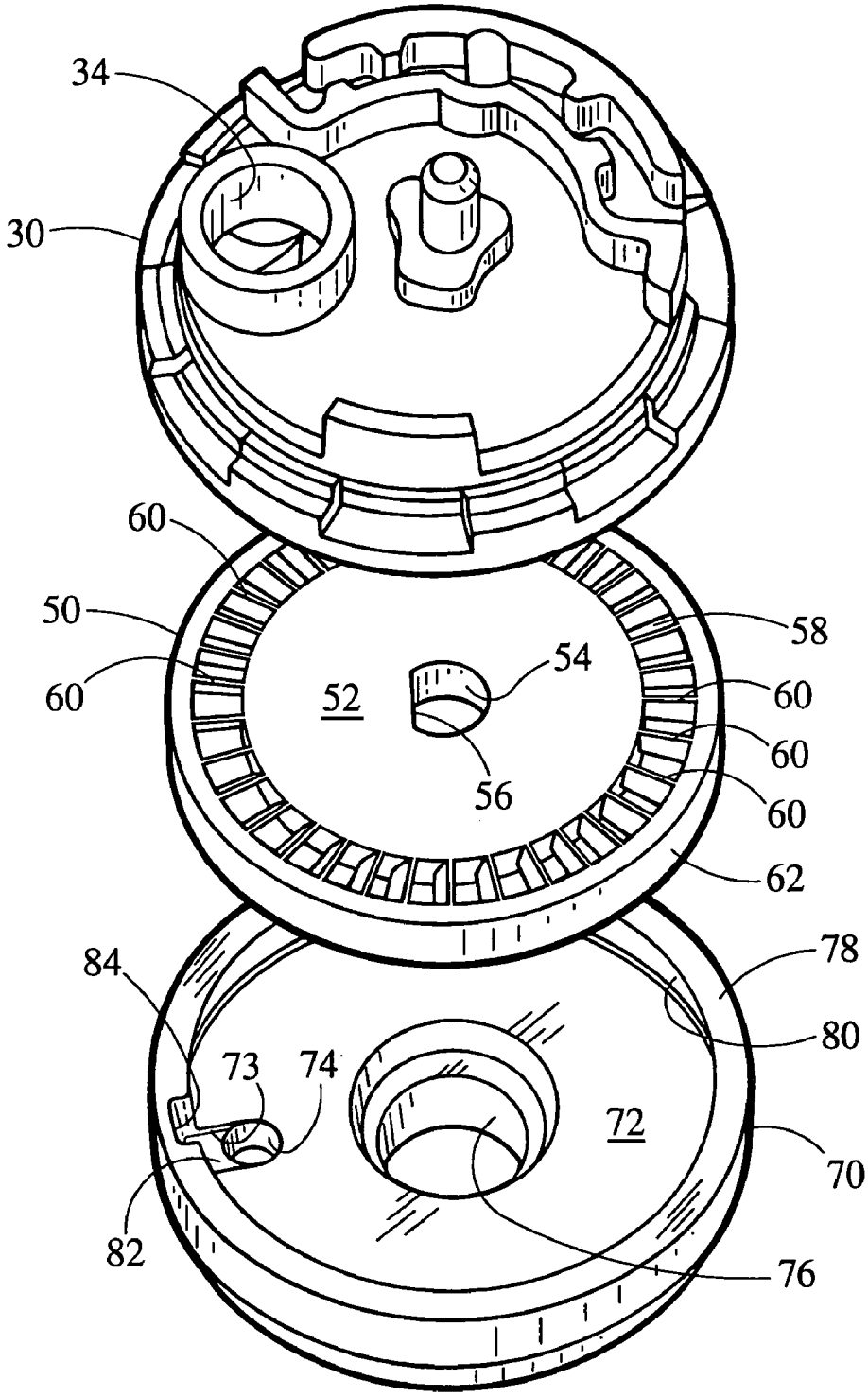
FIG. 2 is an exploded view, in perspective, of the cover, impeller and body forming a portion of the fuel pump depicted in FIG. 1.

Turning now to FIG. 2, an exploded view of the cover 30, impeller 50 and body 70 is shown in perspective. It can be seen that the impeller 50 includes a cover-side surface 52 which defines an impeller flow channel 58 therein. The impeller flow channel 58 extends circumferentially around the impeller 50 and is located adjacent the outer peripheral surface 62 of the impeller 50. The impeller flow channel 58 includes a plurality of vanes 60 which are used to pressurize the fuel, as is known in the art. It can also be seen that the impeller 50 includes an aperture 54 which includes a flat 56 for receiving the shaft which rotatably drives the impeller 50.

The body 70 generally includes a body surface 72 facing axially towards the impeller 50. The body 70 defines an outlet 74 through which pressurized fuel flows for ultimate delivery to the engine. The body 70 also defines a central aperture 76 having a bearing 75 through which the shaft 26 extends for connection to the impeller 50. The body 70 includes a peripheral rim 78 which defines an impeller chamber 80 therein. That is, the peripheral rim 78 and the body surface 72 define an impeller chamber 80 that is sized to receive the impeller 50, as best seen in FIG. 1. Finally, the body 70 defines an outlet passageway 82 which is fluidically connected to the outlet 74. The outlet passageway 82 is at least partially defined by a notch 84 formed in the peripheral rim 78. It can also be seen that the body surface 72 defines a recess 73 therein which connects the notch 84 to the outlet 74.

Figure 3:
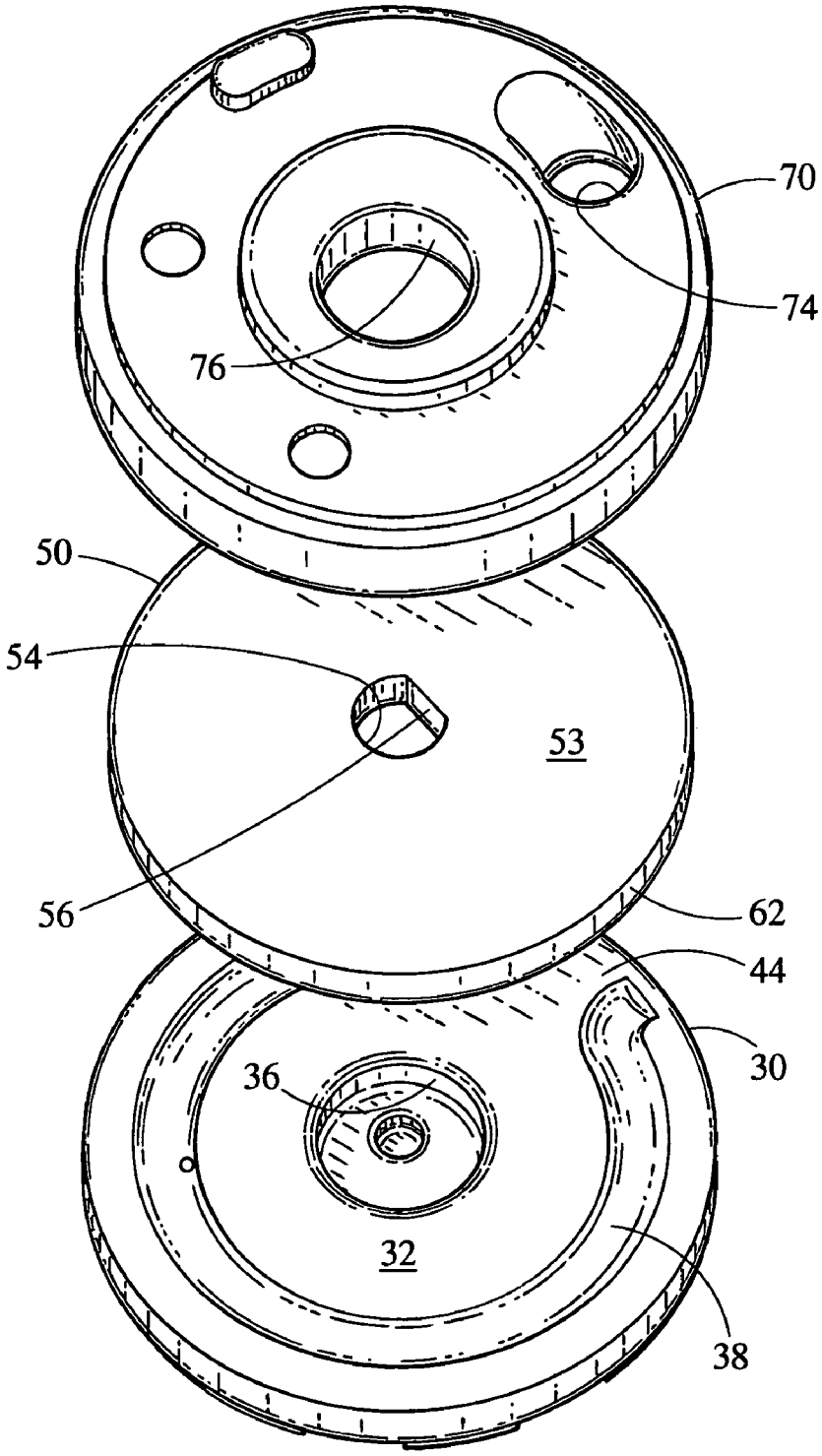
FIG. 3 is an exploded view, in perspective, similar to FIG. 2 but showing the opposing sides of the cover, impeller and body.

The opposing sides of the cover 30, impeller 50 and body 70 are shown in the exploded view of FIG. 3. The cover 30 includes a cover surface 32 facing axially towards the impeller 50. The cover surface 32 defines a recess 36 which is sized to receive the shaft 26 and a thrust button as shown in FIG. 1. The cover surface 32 also defines a cover flow channel 38 which extends circumferentially around the cover 30. The cover flow channel 38 is radially aligned with the impeller flow channel 58 and its vanes 60 (FIG. 2) for pressurizing fuel therein. The cover flow channel 38 extends around the cover 30 about 330°, thereby leaving a strip area 44 between the ends of the cover flow channel 38.

It will also be recognized from FIG. 3 that the impeller 50 includes a body-side surface 53 which does not include any vanes or flow channels, the impeller 50 thus being single sided.

Figure 4:
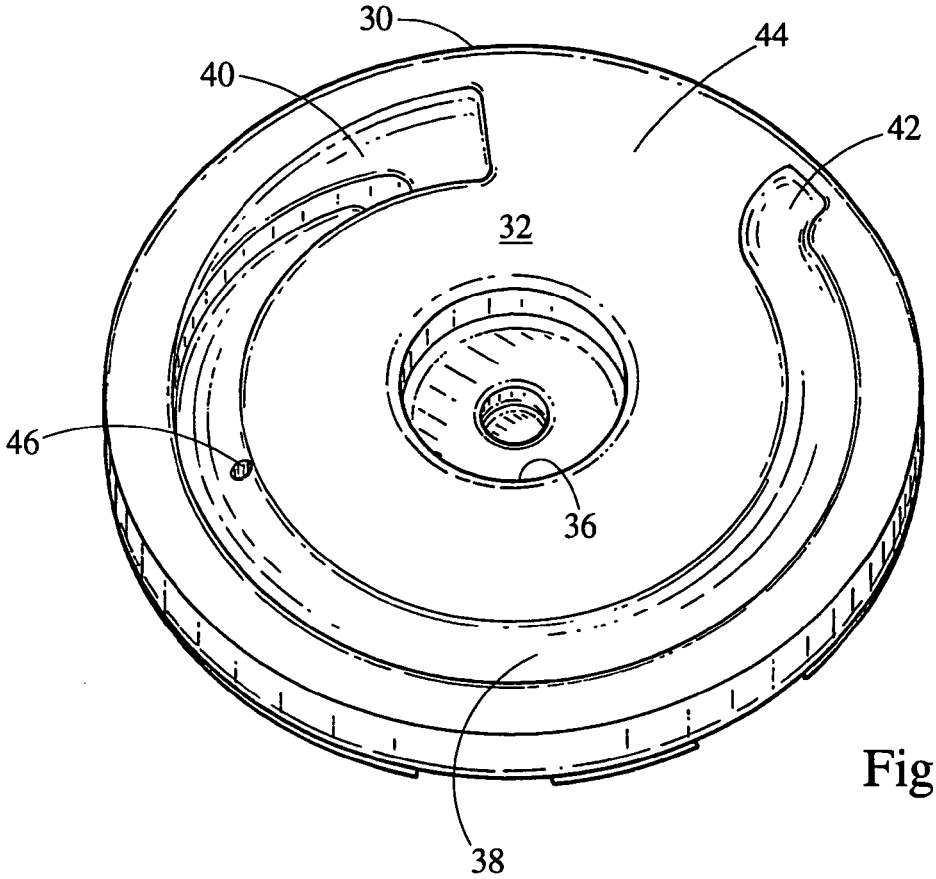
FIG. 4 is an enlarged perspective view of the cover depicted in FIGS. 1-3.

An enlarged view of the cover 30 is shown in FIG. 4. In particular, the cover flow channel 38 can be seen, which includes an inlet end 40 and an outlet end 42. Additionally, the cover flow channel 38 includes a vapor vent hole 46 which is utilized to vent unwanted fuel vapors in the pump 20. The outlet end 42 of the cover flow channel 38 turns and extends radially outwardly, which will be discussed in further detail below.

Figure 5:
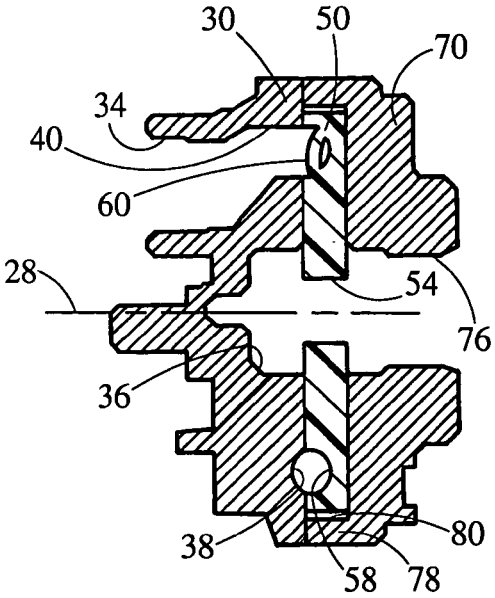
FIG. 5 is a cross-sectional view of the cover, impeller, and body depicted in FIGS. 1-3.

The flow pathway(s) through the cover 30, impeller 50 and body 70 will now be described with reference to the cross-sectional views of FIGS. 5 and 6. When assembled together as shown, the cover 30 and body 70 sandwich the impeller 50 therebetween, the impeller 50 being positioned within the impeller chamber 80 defined by the peripheral rim 78 of the body 70. Working from left to right in FIG. 5, the cover 30 generally includes an inlet 34 through which lower pressure fuel is received for pumping to the engine. The inlet 34 extends axially and communicates with the inlet end 40 of the cover flow channel 38. The cover flow channel 38 is radially aligned with the impeller flow channel 58 formed in the impeller 50. Fuel thus flows into the cover flow channel 38 and impeller flow channel 58, which is pressurized by the vanes 60 and the rotation of the impeller 50 relative to the stationary cover 30 and body 70.

Figure 6:
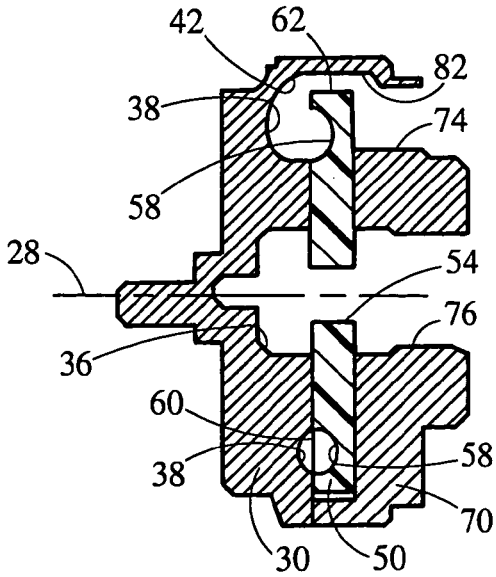
FIG. 6 is a cross-sectional view of the cover, impeller, and body depicted in FIGS. 1-3.

Turning to FIG. 6, the fuel is pressurized as it flows from the inlet end 40 to the outlet end 42 of the cover flow channel 38. As shown in the figure, the outlet end 42 of the cover flow channel 38 turns and extends radially outwardly to a position outside of the outer peripheral surface 62 of the impeller 50. The outlet passageway 82 defined by the body 70 is fluidically connected to the outlet end 42 of the cover flow passageway 38. In this way, higher pressure fuel is allowed to flow around the peripheral surface 62 of the impeller 50, through the outlet passageway 82 and into the outlet 74 defined in the body 70.

Accordingly, by way of the present invention, a more efficient pump 20 is provided by the provision of a single sided impeller 50. The cover flow channel 38 and impeller flow channel 58 are sized to provide a pump 20 which is capable of pumping the same volume of fluid as a comparable pump having a double sided impeller, while at the same time employing a single sided impeller that reduces the wet circle index, and hence losses to friction.

However, a predetermined clearance must be maintained between the impeller 50 and the cover 30 and body 70. In particular, the application of the pump 20 to a motor vehicle requires that the fuel is pressurized to a relatively high level, namely about 2 bar or above. Thus, an axial clearance of about 50 micron (or 0.05 mm) or less must be maintained between the impeller 50 and the cover 30 and body 70. That is, the cover-side surface 52 of the impeller 50 must be maintained within 50 micron (axially) of the cover surface 32 of the cover 30 to be capable of pressurizing fuel to 2 bar or greater.

Unfortunately, the impeller 50 cannot be fixed on the shaft 26. In the harsh environment of a motor vehicle, the fuel pump 20 will be subjected to continuous and repeated operation which causes wear on the thrust button supporting the shaft 26. Thus, over the life of the pump 20, the shaft 26 may shift its position, making it impossible to maintain the ideal clearance between the impeller 50 and the cover 30. Thus, the automotive environment of the pump requires the impeller 50 to be free floating on the shaft 26.

Therefore, the pump 20 according to the teachings of present invention regulates the area of the impeller 50, and in particular the area of the body-side surface 53, that is exposed to the higher pressure fuel in the outlet passageway 82. This is best seen in the cross-sectional view of FIG. 6. In particular, the area of the impeller 50 which is exposed to fuel on its body side 53 is closely sized relative to the area of the cover-side 52 of the impeller 50 which is exposed to fluid. It will be recognized that the area of the impeller 50 which is exposed to fluid on its cover-side surface 52 is defined by the axially facing area of the cover flow channel 38. It will also be recognized that the pressure of fluid in the cover flow channel 38 varies from the inlet end 40 to the outlet end 42. Thus, the pressure of the fluid in the cover flow channel 38 must be averaged, and for purposes here can be generalized as approximately one half of the change in pressure from the inlet end 40 to the outlet end 42.

For example, if lower pressure fluid is provided at the inlet end 40 at about 0 bar, and is pressurized by the pump 20 to a pressure of about 4 bar at the outlet end 42, the average pressure in the cover flow channel 38 can be estimated to be 2 bar. In this example, the higher pressure fuel in the outlet passageway 82 of the body 70 is thus also about 4 bar. Accordingly, the area of the impeller 50 (and in particular the body side surface 53) which is exposed to the outlet passageway 82 is controlled in relation to the exposed area corresponding to the cover flow passageway 38, thereby providing a generally balanced force on opposing sides of the impeller 50. Stated another way, the impeller 50 is subject to a cover-side force and a body-side force, which are designed to be approximately equal.

As used herein, the terms about, approximately, generally and the like, when used in relation to the forces and pressures on the impeller 50, encompass the fact that the actual pressure within the cover flow channel 38 may vary depending upon particular conditions (e.g. pulsations or other pressure variations) which in turn causes the opposing axial forces on the impeller 50 to vary, which in turn causes the impeller 50 to float on the shaft 26, and is known in the art. In our example, the exposed area of the body-side surface 53 of the impeller 50 is approximately one half of the exposed area on the cover-side surface 52 of the impeller 50. In this way, the impeller 50 is allowed to translate axially along the shaft 26 to accommodate pressure variations, while at the same time maintaining an appropriate axial clearance of about 50 micron or less to ensure the ability of the pump to pressurize fuel to high pressure, namely about 2 bar or greater.

Figure 7:
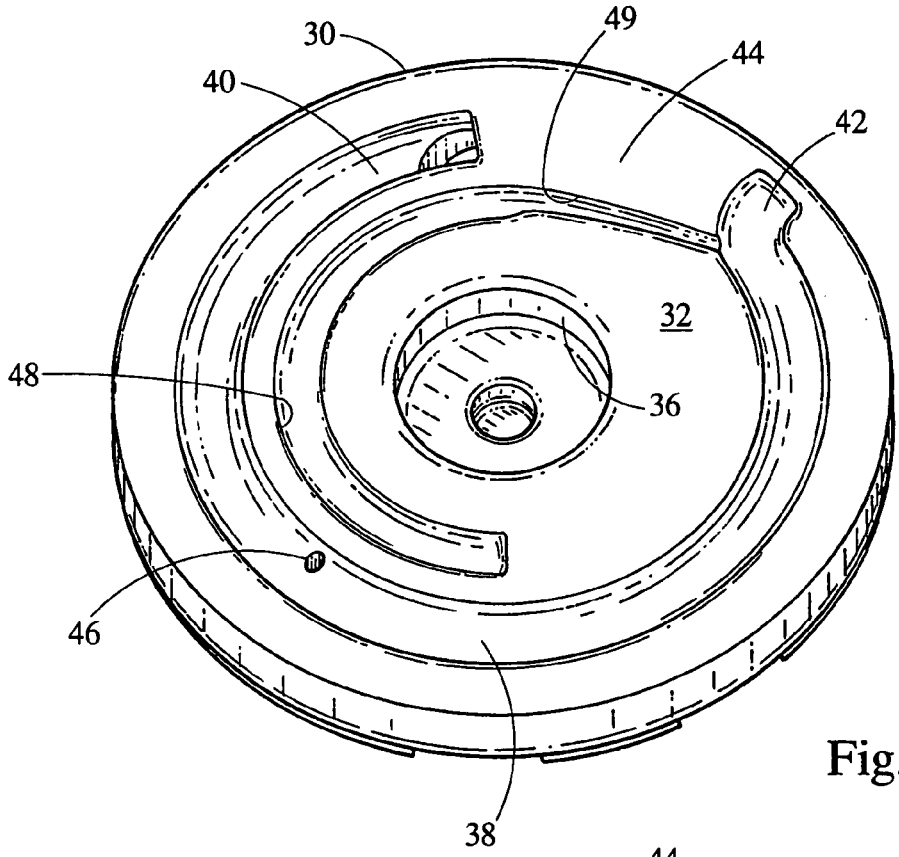
FIG. 7 is an enlarged perspective view similar to FIG. 4 but showing an alternate embodiment of the cover.
Figure 8:
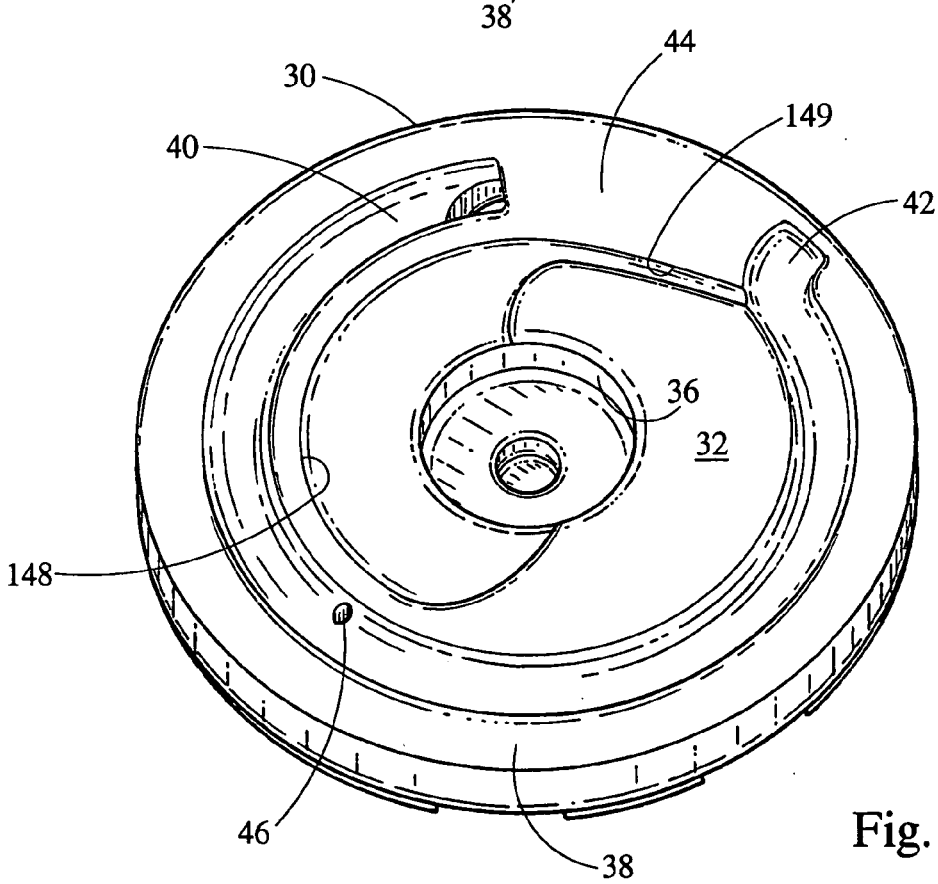
FIG. 8 is an enlarged perspective view similar to FIG. 4 but showing an alternate embodiment of the impeller depicted in FIGS. 1-4.

It will be recognized by those skilled in the art that additional structures may be employed in the cover 30, impeller 50 and/or body 70 in order to facilitate the balancing of the impeller 50 along the shaft 26. Several of numerous embodiments for the cover 30 and body 70 have been depicted in FIGS. 7-10. In particular, FIG. 7 depicts the cover 30 having a pressure balance channel 48 formed in the cover surface 32. The pressure balance channel 48 is positioned radially inside the cover flow channel 38. The pressure balance channel 48 includes a narrowed portion 49 linking the pressure balance channel 48 to the outlet end 42 of the cover flow channel 38. In this manner, higher pressure fuel proximate the outlet end 42 is permitted to flow through the relatively narrow linking portion 49 to the pressure balance channel 48. The pressure balance channel 48 thus contains fluid which provides a portion of the cover-side force on the impeller 50, determined by the axially facing area of the pressure balance channel 48.

It will also be noted that the pressure balance channel 48 is circumferentially aligned with the inlet end 40 of the cover flow channel 38. This construction is employed so that the cover-side force on the impeller 50 is balanced over the entire cover-side area of the impeller 50 (i.e. balancing higher and lower forces). Thus, the pressure balance channel 48 (filled with higher pressure fluid) is aligned with the portion of the cover flow channel 38 having lower pressure fuel (i.e. the inlet end 40). The pressure balance channel 48 extends about 180° or less around the cover 30, but could extend more. It will also be seen that the narrow linking portion 49 of the pressure balance channel 48 is positioned in circumferential alignment with the strip portion 44 of the cover 30.

Turning to FIG. 8, the cover 30 is again shown, but has an alternate version of the pressure balance channel 148. The pressure balance channel 148 still includes a narrowed linking portion 149 proximate the strip area 44. The linking portion 149 connects the pressure balance channel 148 to the higher pressure fuel found at the outlet end 42 of the cover flow channel 38. In this embodiment, the pressure balance channel 148 has a larger cross-sectional area and extends radially inwardly to a point adjacent the recess 36 which is structured to receive the shaft 26 and thrust button. As in the embodiment depicted in FIG. 7, the pressure balance channel 148 is circumferentially aligned with the inlet end 40 and spaced radially inwardly therefrom, and also spans about 180° circumferentially. It will also be recognized by those skilled in the art that either of the embodiments depicted in FIGS. 7 and 8 could include pressure balance channels 48, 148 circumferentially aligned with the outlet end 42 of the cover flow channel 38, and including a linking portion 49, 149 which fluidically connects the pressure balance channel 48, 148 to the inlet end 40 of the cover flow channel 38 which contains lower pressure fuel.

Figure 9:
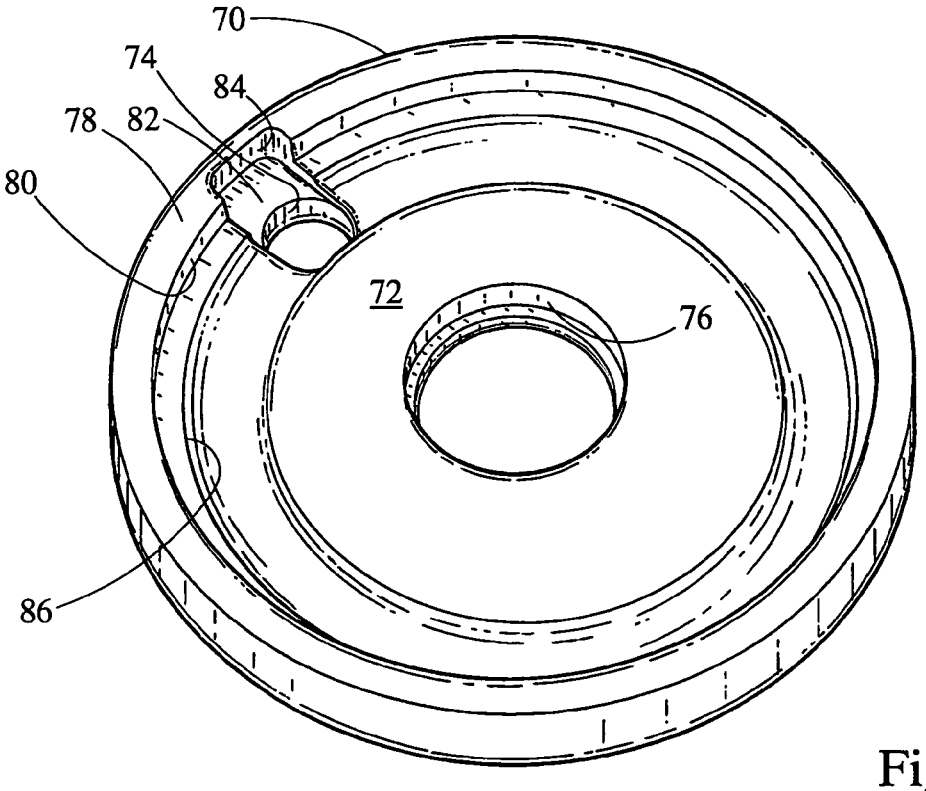
FIG. 9 is an enlarged perspective view of an alternate embodiment of the body depicted in FIGS. 1-3.

FIG. 9 depicts a perspective view of the body 70 which has been shown to include a pressure balance channel 86 defined in the body surface 72. The pressure balance channel 86 extends circumferentially around the body 70. The pressure balance channel 86 extends 360° or less around the body 70. The pressure balance channel 86 is radially aligned with at least a portion of the outlet 74 and outlet passageway 82, although it will be recognized that the pressure balance channel 86 can be positioned anywhere on the body surface 72, and can take any shape, so long as the axial area of the pressure balance channel 86 is sized to properly create balanced forces on the impeller 50. Thus, the embodiment depicted in FIG. 9 provides a pressure balance channel 86 in the body 70 which receives higher pressure fluid from the outlet passageway 82 to form a portion of the body-side force on the impeller 50.

Figure 10:
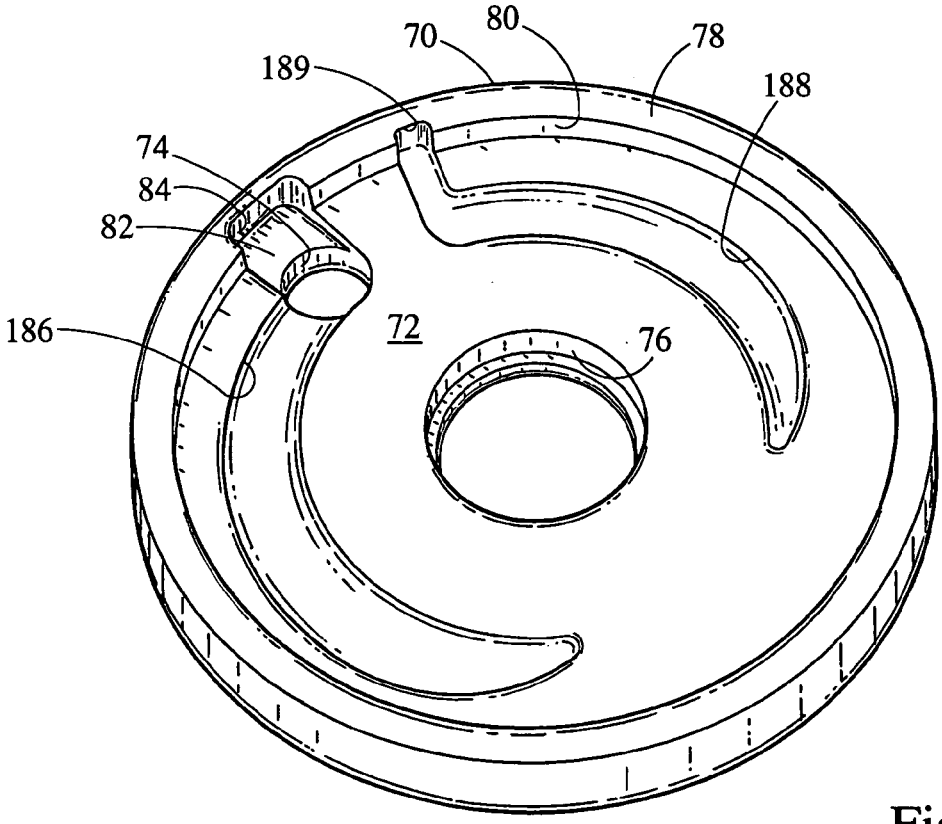
FIG. 10 is an enlarged perspective view of an alternate embodiment of the body depicted in FIGS. 1-3.

With reference to FIG. 10, another embodiment of the body 70 has been depicted including a first pressure balance channel 186 and second pressure balance channel 188. The pressure balance channels 186, 188 are kidney-shaped and generally span about 180° or less around the body 70. The first pressure balance channel 186 is fluidically connected to the outlet passageway 82 and outlet 74, thereby receiving higher pressure fuel. The second balance channel 188 is fluidically connected to lower pressure fuel found proximate the inlet 34 of the cover 30 by way of a passageway 189 formed in the peripheral rim 78 of the cover 70. Generally, the pressure balance channel 186 having higher pressure fuel is circumferentially aligned with the higher pressure portion of the cover flow channel 38 (i.e. the outlet end 42), while the pressure balance channel 188 having lower pressure fluid is circumferentially aligned with the portion of the cover flow channel 38 having lower pressure fuel (i.e. adjacent inlet end 40). In this manner, the stronger cover-side forces on the impeller 50 are balanced against the stronger body-side forces on the impeller, and the same for the lower cover-side and body-side forces on the impeller (i.e. due to lower pressure fluid).

Accordingly, those skilled in the art with recognize that the present invention, as described by the numerous embodiments constructed in accordance with the teachings herein, provides a fuel pump which reduces the wet circle index and increases the efficiency of the pump. A single sided impeller which is free floating on the shaft assists in increasing the efficiency. At the same time, the impeller is balanced along the drive shaft and maintains an axial clearance between the cover and body that is less than about 50 micron, thereby allowing the fuel pump to be applied and the harsh environment of a motor vehicle and to pump fuel at pressures of 2 bar or greater as is required by the conditions of operation.

The foregoing description of various embodiments of the invention has been presented for purposes of illustration and description. It is not intended to be exhaustive or to limit the invention to the precise embodiments disclosed. Numerous modifications or variations are possible in light of the above teachings. For example, all of the flow channels and pressure balance channels formed in any of the cover 30, impeller 50 or body 70 can be of any cross-sectional shape such as square, rectangular, semicircular, semioval, semielliptical, etc. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A fuel pump for a motor vehicle, the fuel pump pressurizing fuel for delivery to an engine, the fuel pump comprising:

a housing;

a motor situated in the housing and driving a shaft, the shaft defining a central axis;

a single sided impeller connected to the shaft for rotation and for axial translation relative to shaft, the impeller having opposed axially facing surfaces including a body-side surface and a cover-side surface, the cover-side surface defining an impeller flow channel extending circumferentially around the impeller, the impeller further including a plurality of vanes positioned at least partially within the impeller flow channel;

a cover attached to the housing, the cover having a cover surface defining a cover flow channel extending circumferentially around the cover and receiving fuel from an inlet formed in the cover, the cover flow channel at least partially aligned with the impeller flow channel, the cover flow channel having an inlet end receiving lower pressure fuel and an outlet end providing higher pressure fuel, the outlet end extending radially outwardly; and a body defined inside the housing, the body defining an impeller chamber having a body surface, the impeller chamber sized to receive the impeller, the body further defining an outlet passageway positioned radially outwardly to fluidically connect to the outlet end of the cover flow channel to receive higher pressure fuel for delivery to the engine.

2. The fuel pump of claim 1, wherein the impeller is subjected to a cover-side force from fuel in the cover flow channel and the impeller flow channel, and wherein the impeller is subjected to a body-side force from fuel in the outlet passageway.

3. The fuel pump of claim 2, wherein the outlet passageway is at least partially exposed to the body-side surface of the impeller, and wherein the area of the impeller exposed to higher pressure fuel in the outlet passageway is sized to provide a body-side force approximately equal to the cover-side force.

4. The fuel pump of claim 3, wherein the exposed area on the body-side of the impeller is less than the area of the cover-side of the impeller exposed to the cover flow channel.

5. The fuel pump of claim 3, wherein the exposed area on the body-side of the impeller is approximately one-half the area of the cover-side of the impeller exposed to the cover flow channel.

6. The fuel pump of claim 2, wherein the body includes a pressure balance channel formed in the body surface, the pressure balance channel in fluidic communication with the outlet passageway, higher pressure fuel in the pressure balance channel providing a portion of the body-side force on the impeller.

7. The fuel pump of claim 6, wherein he pressure balance channel extends circumferentially around the body.

8. The fuel pump of claim 2, wherein the body includes a pressure balance channel formed in the body surface, the pressure balance channel in fluidic communication with the inlet of the cover, fuel in the pressure balance channel providing a portion of the body-side force on the impeller.

9. The fuel pump of claim 2, wherein the cover includes a pressure balance channel formed in the cover surface, the pressure balance channel in fluidic communication with the outlet end of the cover flow passageway, higher pressure fuel in the pressure balance channel providing a portion of the cover-side force on the impeller.

10. The fuel pump of claim 9, wherein the pressure balance channel is positioned radially inwardly from the inlet end of the cover flow channel.

11. The fuel pump of claim 9, wherein the pressure balance channel is positioned circumferentially aligned with the inlet end of the cover flow channel.

12. The fuel pump of claim 1, wherein the impeller maintains an axial clearance between the cover-side surface and the cover surface that is less than or equal to 50 micron by sizing the area of the cover-side surface of the impeller that is exposed to fuel in relation to the area of the body-side surface of the impeller that is exposed to fuel.

13. The fuel pump of claim 1, wherein the impeller maintains an axial clearance between the cover-side surface and the cover surface that is sufficient to pressurize fuel to at least 2 bar by sizing the area of the cover-side surface of the impeller that is exposed to fuel in relation to the area of the body-side surface of the impeller that is exposed to fuel.

14. The fuel pump of claim 1, wherein the outlet end of the cover flow channel extends radially outwardly of the impeller.

15. The fuel pump of claim 1, wherein the outlet passageway is positioned radially outwardly of the impeller.

16. The fuel pump of claim 1, wherein the body includes a peripheral rim partially defining the impeller chamber, the peripheral rim having a notch forming a portion of the outlet passageway.

17. The fuel pump of claim 16, wherein the body includes an aperture defining a portion of the outlet passageway.

18. The fuel pump of claim 17, wherein the aperture is at least partially radially inwardly from the notch.

19. The fuel pump of claim 1, wherein the impeller includes a plurality of circumferentially spaced lubrication flow holes extending axially through the impeller.

20. The fuel pump of claim 1, the fuel pump pressurizing fuel to a pressure of 2 bar or greater for delivery to an engine.

21. The fuel pump of claim 20, wherein the fuel pump does not include a bearing or other structural component limiting the clearance between the cover-side surface of the impeller and the cover surface of the cover.

22. A fuel pump for a motor vehicle, the fuel pump pressurizing fuel for delivery to an engine, the fuel pump including an impeller situated between a cover and a body and situated on a driveshaft for rotation relative to the cover and body, the impeller including vanes on only one axial side of the impeller for pressurizing fuel in a fuel passageway, the impeller being free floating axially on the driveshaft to vary the clearance between the impeller and the cover, the impeller being subjected to a cover-side force and a body-side force from pockets of fuel on the opposing sides of the impeller, the impeller maintaining an axial clearance between itself and the cover that is sufficient to pressurize fluid to at least 2 bar by sizing the area of the cover-side surface of the impeller that is exposed to fluid in relation to the area of the body-side surface of the impeller that is exposed to fluid.

* * * * *